US008475745B2

(12) United States Patent
Wieber

(10) Patent No.: US 8,475,745 B2
(45) Date of Patent: Jul. 2, 2013

(54) APPARATUS FOR HYDROPROCESSING HYDROCARBONS

(75) Inventor: Andrew P. Wieber, Chicago, IL (US)

(73) Assignee: UOP LLC, Des Plaines, IL (US)

( * ) Notice: Subject to any disclaimer, the term of this patent is extended or adjusted under 35 U.S.C. 154(b) by 61 days.

(21) Appl. No.: 13/167,979

(22) Filed: Jun. 24, 2011

(65) Prior Publication Data

US 2012/0294772 A1 Nov. 22, 2012

Related U.S. Application Data

(60) Provisional application No. 61/487,012, filed on May 17, 2011.

(51) Int. Cl.

| | |
|---|---|
| ***B01J 8/04*** | (2006.01) |
| *B01J 10/00* | (2006.01) |
| *B01J 19/00* | (2006.01) |
| *B01J 8/00* | (2006.01) |
| *B01J 29/70* | (2006.01) |
| *C07C 2/00* | (2006.01) |
| *C07C 4/00* | (2006.01) |
| *C07C 5/00* | (2006.01) |
| *C07C 6/00* | (2006.01) |
| *C10G 69/00* | (2006.01) |

(52) U.S. Cl.
USPC ..... 422/630; 422/129; 422/187; 422/600; 585/250; 585/251; 585/265; 585/310; 208/46; 208/49; 208/58

(58) Field of Classification Search
USPC ..... 422/129, 600, 630, 187; 585/250, 585/251, 310, 365; 208/46, 49, 58, 59, 61
See application file for complete search history.

(56) References Cited

U.S. PATENT DOCUMENTS

| | | | | |
|---|---|---|---|---|
| 3,592,757 | A | | 7/1971 | Baral |
| 3,598,722 | A | | 8/1971 | Carson |
| 3,623,974 | A | * | 11/1971 | Mounce et al. ..... 208/67 |
| 3,655,551 | A | | 4/1972 | Hass et al. |
| 4,212,729 | A | | 7/1980 | Hensley, Jr. et al. |
| 5,403,469 | A | | 4/1995 | Vauk et al. |
| 5,447,621 | A | | 9/1995 | Hunter |
| 5,453,177 | A | | 9/1995 | Goebel et al. |
| 5,968,346 | A | | 10/1999 | Jung et al. |
| 6,123,830 | A | | 9/2000 | Gupta et al. |
| 6,149,800 | A | | 11/2000 | Iaccino et al. |
| 6,217,746 | B1 | | 4/2001 | Thakkar et al. |

(Continued)

FOREIGN PATENT DOCUMENTS

| | | | |
|---|---|---|---|
| EP | 0665283 | A2 | 8/1995 |
| WO | 2009008878 | A1 | 1/2009 |
| WO | 2009008879 | A1 | 1/2009 |

OTHER PUBLICATIONS

Bhaskar, "Mild hydrocracking of FCC feeds yields more fuels, boosts margins", Oil & Gas Journal, Jun. 10, 2002, pp. 62-65.

(Continued)

*Primary Examiner* — Jill Warden
*Assistant Examiner* — Natasha Young
(74) *Attorney, Agent, or Firm* — James C Paschall

(57) ABSTRACT

An apparatus and process is disclosed for hydroprocessing hydrocarbon feed in a hydroprocessing unit and hydrotreating a second hydrocarbon. The hydrotreating effluent is mixed with hydroprocessing effluent and together fractionated.

18 Claims, 3 Drawing Sheets

U.S. PATENT DOCUMENTS

| | | | | |
|---|---|---|---|---|
| 6,294,080 | B1 | 9/2001 | Thakkar et al. | |
| 6,315,889 | B1 * | 11/2001 | Thakkar et al. | 208/59 |
| 6,444,116 | B1 | 9/2002 | Galiasso et al. | |
| 6,656,348 | B2 | 12/2003 | Dassori et al. | |
| 6,676,828 | B1 | 1/2004 | Arreaza et al. | |
| 6,740,226 | B2 | 5/2004 | Mehra et al. | |
| 6,843,906 | B1 | 1/2005 | Eng | |
| 7,074,321 | B1 | 7/2006 | Kalnes | |
| 7,087,153 | B1 | 8/2006 | Kalnes | |
| 7,097,760 | B1 | 8/2006 | Kalnes et al. | |
| 7,238,275 | B2 | 7/2007 | Stupin et al. | |
| 7,238,277 | B2 | 7/2007 | Dahlberg et al. | |
| 7,271,303 | B1 | 9/2007 | Sechrist et al. | |
| 7,470,358 | B1 | 12/2008 | Kalnes | |
| 7,507,325 | B2 | 3/2009 | Gueret et al. | |
| 7,531,082 | B2 | 5/2009 | Mukherjee et al. | |
| 7,686,941 | B2 | 3/2010 | Brierley et al. | |
| 7,790,020 | B2 | 9/2010 | Kokayeff et al. | |
| 7,794,588 | B2 | 9/2010 | Kokayeff et al. | |
| 7,815,791 | B2 | 10/2010 | Keusenkothen | |
| 7,837,860 | B1 | 11/2010 | Hoehn et al. | |
| 2003/0089638 | A1 | 5/2003 | Gueret et al. | |
| 2007/0017851 | A1 | 1/2007 | Mehra et al. | |
| 2008/0159928 | A1 | 7/2008 | Kokayeff et al. | |
| 2009/0313890 | A1 | 12/2009 | Lopez et al. | |
| 2009/0321310 | A1 | 12/2009 | Kokayeff et al. | |
| 2009/0321319 | A1 | 12/2009 | Kokayeff et al. | |
| 2010/0043279 | A1 * | 2/2010 | Abhari et al. | 44/308 |
| 2010/0160699 | A1 | 6/2010 | Frey et al. | |
| 2010/0200458 | A1 | 8/2010 | Kalnes | |
| 2012/0251403 | A1 * | 10/2012 | Wieber et al. | 422/187 |

OTHER PUBLICATIONS

Bollinger, "Optimizing Hydrocracker Hydrogen", Chemical Engineering Progress, May 1984, pp. 51-57.

Kimbrell, "Hydrogen Processing", Question and Answer Session on Refining and Petrochemical Technology, pp. 151-152, presented at the NPRA Conference, 1996.

Putek, "Upgrade hydrocracked resid through integrated hydrotreating", Hydrocarbon Processing, Sep. 2008, pp. 83-92.

Turner, "Consider revamping hydrotreaters to handle higher H2 partial pressures", Hydrocarbon Processing, Mar. 2004, pp. 61-70.

Zhu, "Application of high pressure hot separation schemes in hydrocrackers", Petroleum Refinery Engineering, Sep. 1995, vol. 25, No. 5, pp. 1-5. (in Chinese with full translation).

U.S. Appl. No. 13/076,647, filed Mar. 31, 2011, Wieber.

U.S. Appl. No. 13/076,658, filed Mar. 31, 2011, Wieber.

U.S. Appl. No. 13/076,670, filed Mar. 31, 2011, Wieber.

U.S. Appl. No. 13/076,680, filed Mar. 31, 2011, Wieber.

U.S. Appl. No. 13/076,608, filed Mar. 31, 2011, Wieber.

U.S. Appl. No. 13/076,631, filed Mar. 31, 2011, Wieber.

U.S. Appl. No. 13/167,945, filed Jun. 24, 2011, Wieber.

U.S. Appl. No. 13/168,052, filed Jun. 24, 2011, Wieber.

U.S. Appl. No. 13/168,078, filed Jun. 24, 2011, Wieber.

U.S. Appl. No. 13/324,186, filed Dec. 13, 2011, Zimmerman et al.

U.S. Appl. No. 13/324,209, filed Dec. 13, 2011, Zimmerman et al.

* cited by examiner

APPARATUS FOR HYDROPROCESSING HYDROCARBONS

CROSS-REFERENCE TO RELATED APPLICATION

This application claims priority from Provisional Application No. 61/487,012 filed May 17, 2011, the contents of which are hereby incorporated by reference.

FIELD OF THE INVENTION

The field of the invention is the hydroprocessing of two hydrocarbon streams.

BACKGROUND OF THE INVENTION

Hydroprocessing can include processes which convert hydrocarbons in the presence of hydroprocessing catalyst and hydrogen to more valuable products. Hydrocracking is a hydroprocessing process in which hydrocarbons crack in the presence of hydrogen and hydrocracking catalyst to lower molecular weight hydrocarbons. Depending on the desired output, the hydrocracking zone may contain one or more beds of the same or different catalyst. Hydrocracking is a process used to crack hydrocarbon feeds such as vacuum gas oil (VGO) to diesel including kerosene and gasoline motor fuels.

Due to environmental concerns and newly enacted rules and regulations, saleable diesel must meet lower and lower limits on contaminates, such as sulfur and nitrogen. New regulations require essentially complete removal of sulfur from diesel. For example, the ultra low sulfur diesel (ULSD) requirement is typically less than about 10 wppm sulfur.

Hydrotreating is a hydroprocessing process used to remove heteroatoms such as sulfur and nitrogen from hydrocarbon streams to meet fuel specifications and to saturate olefinic compounds. Hydrotreating can be performed at high or low pressures, but is typically operated at lower pressure than hydrocracking. In such cases, there is need of coordinating process units when they are operated at different pressures.

There is a continuing need, therefore, for improved methods of producing motor fuel products from hydrocarbon feedstocks. Such methods must ensure that the motor fuel product meets increasingly stringent product requirements.

BRIEF SUMMARY OF THE INVENTION

In an apparatus embodiment, the invention comprises a hydrocracking and hydrotreating apparatus comprising a hydrocracking reactor in communication with a first hydrogen line and a first hydrocarbon feed line for hydrocracking a hydrocarbon stream to lower boiling hydrocarbons transported in a hydrocracking effluent line. A hydrotreating reactor is in communication with a second hydrogen line and a second hydrocarbon feed line for hydrotreating a diesel stream to produce a hydrotreating effluent in a hydrotreating effluent line. The hydrotreating effluent line is in communication with said hydrocracking effluent line. A fractionation section communicates with said hydrotreating effluent line and said hydrocracking effluent line.

In an additional apparatus embodiment, the invention further comprises a hydrocracking and hydrotreating apparatus comprising a hydrocracking reactor in communication with a first hydrogen line and a first hydrocarbon feed line for hydrocracking a first hydrocarbon feed stream to lower boiling hydrocarbons transported in a hydrocracking effluent line. A cold separator is in communication with said hydrocracking effluent line for separating said hydrocracking effluent into a vaporous hydrocracking effluent stream comprising hydrogen in an overhead line and a liquid hydrocracking effluent stream in a bottoms line. A hydrotreating reactor is in communication with a second hydrogen line and a second hydrocarbon feed line for hydrotreating a second hydrocarbon feed stream to produce hydrotreating effluent in a hydrotreating effluent line. The hydrotreating effluent line is in communication with said bottoms line. A fractionation section is in communication with said hydrotreating effluent line and said cold separator.

In a further apparatus embodiment, the invention comprises a hydrocracking and hydrotreating apparatus comprising a hydrocracking reactor in communication with a first hydrogen line and a first hydrocarbon feed line for hydrocracking a first hydrocarbon feed stream to lower boiling hydrocarbons transported in a hydrocracking effluent line. A cold separator is in communication with said hydrocracking effluent line for separating said hydrocracking effluent into a vaporous hydrocracking effluent stream comprising hydrogen in an overhead line and a liquid hydrocracking effluent stream in a bottoms line. The first hydrogen line is in communication with said overhead line. A hydrotreating reactor is in communication with a second hydrogen line and a second hydrocarbon feed line for hydrotreating a second hydrocarbon feed stream to produce hydrotreating effluent in a hydrotreating effluent line. A flash drum is in communication with said hydrotreating effluent line and said liquid hydrocracking effluent line for providing a cold flash vapor stream in a flash overhead line and a cold flash liquid stream in a flash bottoms line. The second hydrogen line is in communication with said flash overhead line.

DEFINITIONS

Figure 1:
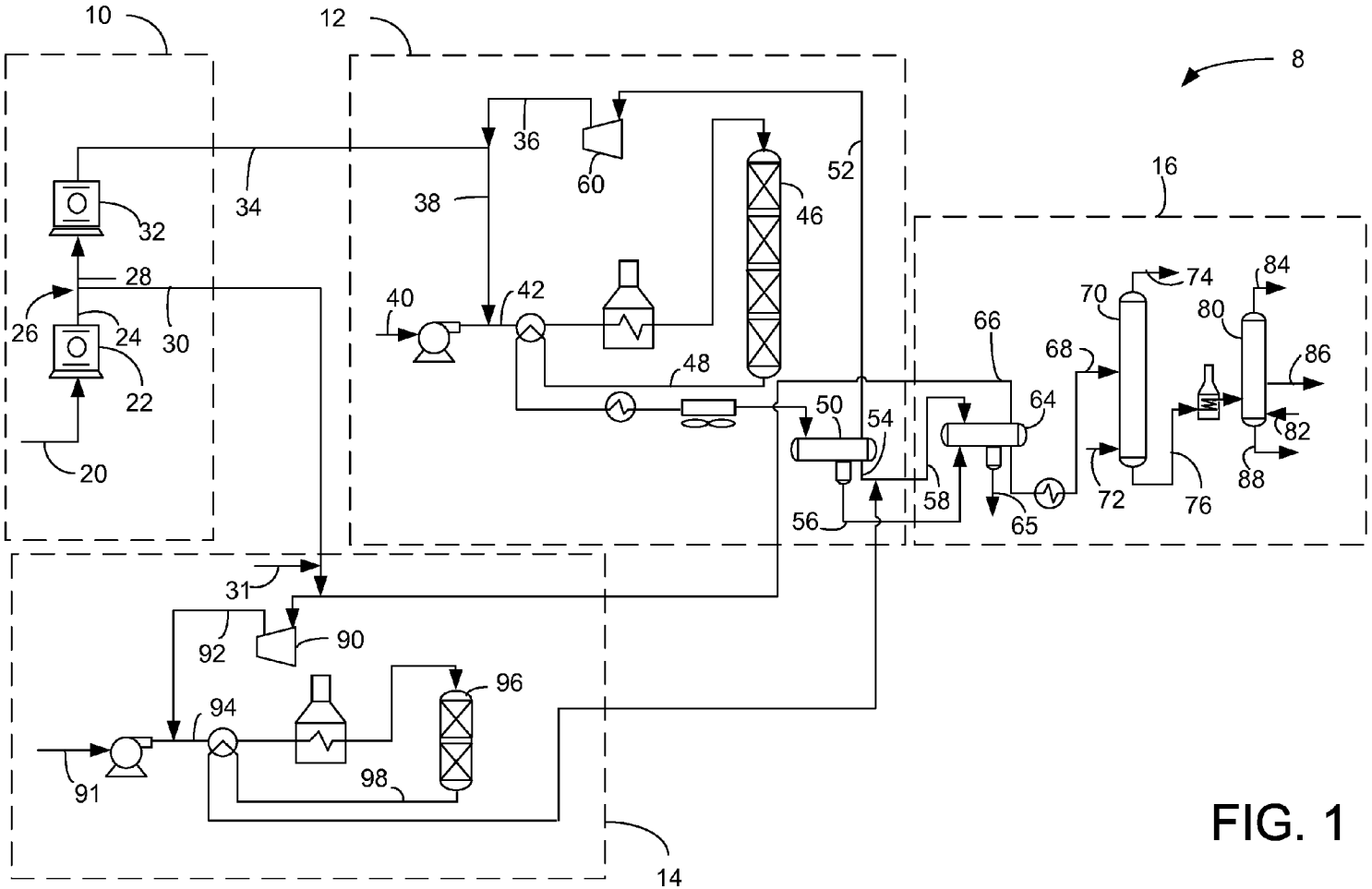
FIG. 1 is a simplified process flow diagram of an embodiment of the present invention.

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The top pressure is the pressure of the overhead vapor at the vapor outlet of the column. The bottom temperature is the liquid bottom outlet temperature. Overhead lines and bottoms lines refer to the net lines from the column downstream of the reflux or reboil to the column.

As used herein, the term "True Boiling Point" (TBP) means a test method for determining the boiling point of a material which corresponds to ASTM D2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "conversion" means conversion of feed to material that boils at or below the diesel boiling range. The diesel cut point of the diesel boiling range is between about 343° and about 399° C. (650° to 750° F.) using the True Boiling Point distillation method.

As used herein, the term "diesel boiling range" means hydrocarbons boiling in the range of between about 132° and about 399° C. (270° to 750° F.) using the True Boiling Point distillation method.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator that may be operated at higher pressure.

DETAILED DESCRIPTION

A typical high pressure hydroprocessing unit such as a hydrocracking unit or a high pressure hydrotreating unit has both a cold separator and a cold flash drum. It often, but not always, has a hot separator and a hot flash drum. Many hydrotreating unit have only a cold separator. The high pressure hydroprocessing unit operates at a higher pressure than the hydrotreating unit. It is proposed that hydrotreating effluent be mixed with at least a portion of the hydroprocessing effluent. A cold flash drum separates a portion of the hydroprocessing effluent and the hydrotreating effluent into a vapor stream that is recycled to the hydrotreating unit to provide hydrotreating hydrogen requirements. The hydroprocessing and hydrotreating liquid from the cold flash drum may be fractionated together into products in a fractionation section.

The apparatus and process 8 for hydroprocessing hydrocarbons comprise a compression section 10, a hydroprocessing unit 12, a hydrotreating unit 14 and a fractionation section 16. A first hydrocarbon feed is first fed to the hydroprocessing unit 12 that may be a hydrocracking unit 12 that converts the feed to lower boiling hydrocarbons which may include diesel. Hydroprocessing effluent is fractionated in the fractionation section 16. A second hydrocarbon feed stream is fed to the hydrotreating unit 14 to provide a hydrotreating effluent stream. A diesel stream provided from the fractionation section 16 may be the second hydrocarbon feed stream which is hydrotreated to provide low sulfur diesel.

The compression section 10 may be arranged to provide two make-up hydrogen streams at different pressures. In this interstage compression arrangement of the compression section 10, a make-up hydrogen stream in a make-up hydrogen line 20 is fed to a first compressor 22 in downstream communication with the make-up hydrogen line 20 to boost the pressure of the make-up hydrogen stream and provide a first compressed make-up hydrogen stream in a first compressed make-up hydrogen line 24. The first compressor 22 is a compression stage that may represent a series of compressors.

A split 26 in downstream communication with the first compressor 22 on the first compressed make-up hydrogen line 24 allows a first portion of compressed make-up hydrogen to be taken in a first split line 28 and a second portion of compressed make-up hydrogen to be taken in a second split line 30. The second portion of the first compressed make-up hydrogen in the second split line 30 is forwarded to the hydrotreating unit 14.

The first portion of compressed make-up hydrogen in the first split line 28 may be further compressed in a second compressor 32 to provide a second compressed make-up stream in line 34. The second compressor 32 is a compression stage that may represent a series of compressors. The second compressor 32 is in downstream communication with the first split line 28 and the first compressor 22. The second compressed make-up stream in line 34 may be joined by a first recycle hydrogen stream in line 36 to provide a first hydroprocessing hydrogen stream in line 38. The first hydroprocessing hydrogen line 38 is in downstream communication with the second compressed make-up hydrogen line 34, two compressors 22 and 32, and the first recycle hydrogen stream in line 36. The interstage compression arrangement provides for the second compressed make-up hydrogen stream 34 to be provided to the hydroprocessing section 12 at a higher pressure than the second portion of the compressed make-up hydrogen stream in the second split line 30.

Other compression arrangements are contemplated. For example, the compressed make-up hydrogen stream in the second split line 30 may be supplemented or supplanted by a third make-up hydrogen stream in line 31 which may provide lower purity hydrogen such that is sufficiently pure for the needs of the hydrotreating unit 14. It is also contemplated that the second split line 30 be located downstream of the second compressor 32 in which case both the hydroprocessing unit 12 and the hydrotreating unit 14 would operate at near the same pressure.

A first hydrocarbon feed stream may be introduced in line 40 perhaps through a surge tank which is not shown. The first hydroprocessing hydrogen line 38 may join the first hydrocarbon feed stream in line 40 to provide a first hydroprocessing feed stream in line 42. In one aspect, the process and apparatus described herein are particularly useful for hydroprocessing a hydrocarbonaceous feedstock. Illustrative hydrocarbon feedstocks include hydrocarbonaceous streams having components boiling above about 288° C. (550° F.), such as atmospheric gas oils, VGO, deasphalted, vacuum, and atmospheric residua, coker distillates, straight run distillates, solvent-deasphalted oils, pyrolysis-derived oils, high boiling synthetic oils, cycle oils, hydrocracked feeds, cat cracker distillates and the like. These hydrocarbonaceous feed stocks may contain from about 0.1 to about 4 wt-% sulfur.

A suitable hydrocarbon feedstock is a VGO or other hydrocarbon fraction having at least about 50 percent by weight, and usually at least about 75 percent by weight, of its components boiling at a temperature above about 399° C. (750° F.). A typical VGO normally has a boiling point range between about 315° C. (600° F.) and about 565° C. (1050° F.).

Hydroprocessing that occurs in the hydroprocessing unit may be hydrocracking or hydrotreating. Hydrocracking refers to a process in which hydrocarbons crack in the presence of hydrogen to lower molecular weight hydrocarbons. Hydroprocessing that occurs in the hydroprocessing unit may also be hydrotreating. Hydrotreating that may occur in the hydroprocessing unit 12 will be described below in reference to the hydrotreating unit 14. In any case, the pressure of the hydroprocessing unit 12 may be higher than in the hydrotreating unit 14. Hydrocracking is the preferred process in the hydroprocessing unit 12. Consequently, the term "hydroprocessing" will include the term "hydrocracking" and the term "hydrocracking" may mean a type of the term "hydroprocessing" herein.

A hydroprocessing reactor 46 which may be a hydrocracking reactor 46 is in downstream communication with one or more compressors 22 and 32 on the make-up hydrogen line 20, the first split line 28 and the first hydrocarbon feed line 40. The first hydroprocessing feed stream in line 42 may be heat exchanged with a hydroprocessing effluent stream which may be a hydrocracking effluent stream in hydrocracking effluent line 48 and further heated in a fired heater before entering the hydrocracking reactor 46 which may be for hydrocracking the hydrocarbon stream to lower boiling hydrocarbons.

The hydroprocessing reactor 46 may comprise one or more vessels, multiple beds of catalyst in each vessel, and various combinations of hydrotreating catalyst and hydrocracking catalyst in one or more vessels. In some aspects, a hydrocracking reaction may provide total conversion of at least about 20 vol-% and typically greater than about 60 vol-% of the hydrocarbon feed to products boiling below the diesel cut point. The hydroprocessing reactor 46 may operate at partial conversion of more than about 50 vol-% or full conversion of at least about 90 vol-% of the feed based on total conversion. To maximize diesel, full conversion is effective. The first vessel or bed may include hydrotreating catalyst for the purpose of saturating, demetallizing, desulfurizing or denitrogenating the hydrocracking feed.

The hydroprocessing reactor 46 may be operated at mild hydrocracking conditions. Mild hydrocracking conditions will provide about 20 to about 60 vol-%, preferably about 20 to about 50 vol-%, total conversion of the hydrocarbon feed to product boiling below the diesel cut point. In mild hydrocracking, converted products are biased in favor of diesel. In a mild hydrocracking operation, the hydrotreating catalyst has just as much or a greater conversion role than hydrocracking catalyst. Conversion across the hydrotreating catalyst may be a significant portion of the overall conversion. If the hydroprocessing reactor 46 is intended for mild hydrocracking, it is contemplated that the mild hydrocracking reactor 46 may be loaded with all hydrotreating catalyst, all hydrocracking catalyst, or some beds of hydrotreating catalyst and some beds of hydrocracking catalyst. In the last case, the beds of hydrocracking catalyst may typically follow beds of hydrotreating catalyst. Most typically, three beds of hydrotreating catalyst may be followed by zero, one or two 2 beds of hydrocracking catalyst.

The hydroprocessing reactor 46 in FIG. 1 has four beds in one reactor vessel. If mild hydrocracking is desired, it is contemplated that the first three catalyst beds comprise hydrotreating catalyst and the last catalyst bed comprise hydrocracking catalyst. If partial or full hydrocracking is preferred, more beds of hydrocracking catalyst may be used in addition to the number of beds used in mild hydrocracking.

At mild hydrocracking conditions, the feed is selectively converted to heavy products such as diesel and kerosene with a low yield of lighter hydrocarbons such as naphtha and gas. Pressure is also moderate to limit the hydrogenation of the bottoms product to an optimal level for downstream processing.

In one aspect, for example, when a balance of middle distillate and gasoline is preferred in the converted product, mild hydrocracking may be performed in the first hydrocracking reactor 46 with hydrocracking catalysts that utilize amorphous silica-alumina bases or low-level zeolite bases combined with one or more Group VIII or Group VIB metal hydrogenating components. In another aspect, when middle distillate is significantly preferred in the converted product over gasoline production, partial or full hydrocracking may be performed in the first hydrocracking reactor 46 with a catalyst which comprises, in general, any crystalline zeolite cracking base upon which is deposited a Group VIII metal hydrogenating component. Additional hydrogenating components may be selected from Group VIB for incorporation with the zeolite base.

The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and about 14 Angstroms ($10^{-10}$ meters). It is preferred to employ zeolites having a relatively high silica/alumina mole ratio between about 3 and about 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8-12 Angstroms ($10^{-10}$ meters), wherein the silica/alumina mole ratio is about 4 to 6. One example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. In one aspect, the preferred cracking bases are those which are at least about 10 percent, and preferably at least about 20 percent, metal-cation-deficient, based on the initial ion-exchange capacity. In another aspect, a desirable and stable class of zeolites is one wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and about 30 percent by weight may be used. In the case of the noble metals, it is normally preferred to use about 0.05 to about 2 wt-%.

The method for incorporating the hydrogenating metal is to contact the base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., about 371° to about 648° C. (about 700° to about 1200° F.) in order to activate the catalyst and decompose ammonium ions. Alternatively, the base component may first be pelleted, followed by the addition of the hydrogenating component and activation by calcining.

The foregoing catalysts may be employed in undiluted form, or the powdered catalyst may be mixed and copelleted with other relatively less active catalysts, diluents or binders such as alumina, silica gel, silica-alumina cogels, activated clays and the like in proportions ranging between about 5 and about 90 wt-%. These diluents may be employed as such or they may contain a minor proportion of an added hydrogenating metal such as a Group VIB and/or Group VIII metal. Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718.

By one approach, the hydrocracking conditions may include a temperature from about 290° C. (550° F.) to about 468° C. (875° F.), preferably 343° C. (650° F.) to about 435° C. (815° F.), a pressure from about 4.8 MPa (700 psig) to about 20.7 MPa (3000 psig), a liquid hourly space velocity (LHSV) from about 1.0 to less than about 2.5 $hr^{-1}$ and a hydrogen rate of about 421 (2,500 scf/bbl) to about 2,527 $Nm^3/m^3$ oil (15,000 scf/bbl). If mild hydrocracking is desired, conditions may include a temperature from about 315° C. (600° F.) to about 441° C. (825° F.), a pressure from about 5.5 MPa (gauge) (800 psig) to about 13.8 MPa (gauge) (2000 psig) or more typically about 6.9 MPa (gauge) (1000 psig) to about 11.0 MPa (gauge) (1600 psig), a liquid hourly space velocity (LHSV) from about 0.5 to about 2 $hr^{-1}$ and preferably about 0.7 to about 1.5 $hr^{-1}$ and a hydrogen rate of about 421 $Nm^3/m^3$ oil (2,500 scf/bbl) to about 1,685 $Nm^3/m^3$ oil (10,000 scf/bbl).

A hydroprocessing effluent which is preferably a hydrocracking effluent exits the hydrocracking reactor 46 and is transported in hydroprocessing effluent line which may be a hydrocracking effluent line 48. The hydrocracking effluent stream preferably comprises the first hydrocarbon feed stream that has been hydrocracked down to lower boiling hydrocarbons. The hydrocracking effluent in hydroprocessing effluent line 48 may be heat exchanged with the first hydroprocessing feed stream in line 42 and in an embodiment may be cooled before entering a cold separator 50. The cold separator 50 is in downstream communication with the hydrocracking reactor 46. The cold separator may be operated at about 46° to about 63° C. (115° to 145° F.) and just below the pressure of the hydroprocessing reactor 46 accounting for pressure drop to keep hydrogen and light gases in the overhead and normally liquid hydrocarbons in the bottoms. The cold separator 50 separates the hydroprocessing effluent which may be a hydrocracking effluent to provide a vaporous hydroprocessing effluent stream which may be a vaporous hydrocracking effluent stream comprising hydrogen in an overhead line 52 and a liquid hydroprocessing effluent stream which may be a liquid hydrocracking effluent stream in a bottoms line 54. Since the bottoms line carries at least a portion of the hydroprocessing effluent which may be a hydrocracking effluent, it is considered a hydroprocessing effluent line which may be a hydrocracking effluent line 48. The cold separator also has a boot for collecting an aqueous phase in line 56. The cold separator 50 serves to separate hydrogen from hydroprocessing effluent in hydroprocessing effluent line 48 for recycle to the hydroprocessing reactor 46 in the overhead line 52.

The vaporous hydrocracking effluent stream in overhead line 52 may be compressed in a recycle compressor 60 to provide the first recycle hydrogen stream in line 36 which is a compressed vaporous hydroprocessing effluent stream which may be a vaporous hydrocracking effluent stream. Before compression, the gas may be scrubbed of impurities such as hydrogen sulfide, but this is not shown in FIG. 1. The recycle compressor 60 may be in downstream communication with the hydrocracking reactor 46. Consequently, the first recycle compressor 60 is in downstream communication with the overhead line 52 of the cold separator 50.

In an embodiment, the first recycle hydrogen stream in line 36 may join with second compressed make-up hydrogen stream in line 34 downstream of the recycle gas compressor 60. However, if the pressure of the recycle hydrogen stream in line 36 is too great to admit the make-up hydrogen stream without adding more compressors on the make-up hydrogen line 20, the make-up hydrogen stream may be added to the vaporous hydrocracking effluent stream in overhead line 52 upstream of the recycle compressor 60. However, this would increase the duty on the recycle compressor 60 due to greater throughput.

The first recycle hydrogen stream in line 36 may combine with the second compressed make-up hydrogen stream in line 34 to provide the first hydrogen stream in first hydrogen line 38. Consequently, the first hydrogen line 38 is in downstream communication with the overhead line 52 of the cold separator 50.

At least a portion of the hydroprocessing effluent stream in a hydroprocessing effluent line 48 may be fractionated in a fractionation section 16 in downstream communication with the hydrocracking reactor 46. In an aspect, the liquid hydrocracking effluent stream in the bottoms line 54 may be fractionated in the fractionation section 16. Separation in the cold separator is not considered fractionation herein.

In a further aspect, the fractionation section 16 may include a cold flash drum 64. The cold flash drum may be any separator that splits the liquid hydroprocessing effluent into vapor and liquid fractions. At least a portion of the hydroprocessing effluent stream in line 48 is mixed with at least a portion of the hydrotreating effluent stream in line 98 to provide a mixture. Specifically, the liquid hydroprocessing effluent stream which may be a liquid hydrocracking effluent stream in the bottoms line 54 may be mixed with a hydrotreating effluent stream from the hydrotreating effluent line 98 and flashed in the cold flash drum 64. In this aspect, the bottoms line 54 is joined by hydrotreating effluent line 98 to provide combine line 58. The cold flash drum may be in downstream communication with the bottoms line 54 of the cold separator 50 and the hydrotreating reactor 96 via the combine line 58. The cold flash drum may be operated at the same temperature as the cold separator 50 but typically at a lower pressure of between about 2.1 MPa (gauge) (300 psig) and about 7.0 MPa (gauge) (1000 psig) and preferably 4.1 MPa (gauge) (600 psig) and about 5.5 MPa (gauge) (800 psig). The lower pressure cold flash drum is able to admit the lower pressure hydrotreating effluent in line 98.

The hydrotreating effluent stream in line 98 may be introduced to the cold flash drum 64 separately from the liquid hydrocracking effluent stream in bottoms line 54 and mixed in the cold flash drum 64. The flashing in the cold flash drum 64 produces a cold flash vapor stream in a cold flash overhead line 66 and cold flash liquid stream in a cold flash bottoms line 68 from flashing the liquid hydrocracking effluent stream and the hydrotreating effluent stream. The aqueous stream in line 56 from the boot of the cold separator may also be directed to the cold flash drum 64. A flash aqueous stream is removed from a boot in the cold flash drum 64 in line 65. The cold flash liquid stream in the flash bottoms line 68 comprising liquids from both the hydroprocessing effluent in hydroprocessing effluent line 48 and hydrotreating effluent in hydrotreating effluent line 98 may be further fractionated in the fractionation section 16. At least a portion of the mixture of liquid hydroprocessing effluent in the bottoms line 54 and hydrotreating effluent in line 98 is fractionated in the fractionation section 16. The fractionation section 16 may be in downstream communication with the hydrotreating effluent line 98 and the hydrocracking effluent line 48.

The fractionation section 16 may include a stripping column 70 and a fractionation column 80. The cold flash liquid stream in the flash bottoms line 68 may be heated and fed to the stripping column 70. The cold flash liquid stream which comprises at least a portion of the liquid hydrocracking effluent and the hydrotreating effluent may be stripped with steam from line 72 to provide a light ends stream of hydrogen, hydrogen sulfide, steam and other gases in an overhead line 74. A portion of the light ends stream may be condensed and refluxed to the stripper column 70. The stripping column 70 may be operated with a bottoms temperature between about 232° (450° F.) and about 288° C. (550° F.) and an overhead pressure of about 690 kPa (gauge) (100 psig) to about 1034 kPa (gauge) (150 psig). A hydrocracked bottoms stream in line 76 may be heated in a fired heater and fed to the fractionation column 80. Consequently, the fractionation column 80 is in downstream communication with the flash bottoms line 68 of the cold flash drum 64.

The fractionation column 80 may also strip the hydrocracked bottoms with steam from line 82 to provide an overhead naphtha stream in line 84, a diesel stream carried in line 86 from a side cut and an unconverted oil stream in line 88 which may be suitable for further processing, such as in an FCC unit. The overhead naphtha stream in line 84 may require further processing before blending in the gasoline pool. It will usually require catalytic reforming to improve the octane number. The reforming catalyst will often require the overhead naphtha to be further desulfurized in a naphtha hydrotreater prior to reforming. In an aspect, the hydrocracked naphtha may be desulfurized in an integrated hydrotreater 96. It is also contemplated that a further side cut that is not shown be taken to provide a separate light diesel or kerosene stream taken above a heavy diesel stream taken in diesel line 86. Consequently, at least a part of the hydroprocessing effluent stream which may be the hydrocracked effluent stream in line 48 may be fractionated to provide the diesel stream in diesel line 86.

A portion of the overhead naphtha stream in line 84 may be condensed and refluxed to the fractionation column 80. The fractionation column 80 may be operated with a bottoms temperature between about 288° C. (550° F.) and about 385° C. (725° F.), preferably between about 315° C. (600° F.) and about 357° C. (675° F.) and at or near atmospheric pressure. A portion of the hydrocracked bottoms may be reboiled and returned to the fractionation column 80 instead of using steam stripping.

The diesel stream in line 86 is reduced in sulfur content and may meet a low sulfur diesel (LSD) specification which is less than 50 wppm sulfur or an ULSD specification which is less than 10 wppm sulfur, or other specifications.

The cold flash vapor stream comprising hydrogen in the cold flash overhead line 66 may provide hydrotreating hydrogen requirements to the hydrotreating section 14. A second recycle compressor 90 may be in downstream communication with the flash overhead line 66 of the cold flash drum 64 and the second split line 30 carrying a second portion of the first compressed make-up hydrogen stream and/or the third make-up hydrogen stream in line 31 for compressing one, two or all of these streams to provide a second hydrogen stream in line 92. It is also envisioned that the second portion of the first compressed make-up hydrogen stream in second split line 30 and/or the third make-up hydrogen stream in line 31 join the cold flash overhead line 66 downstream of the second recycle compressor 90. The second hydrogen line 92 may be in downstream communication with the supplemental hydrogen line 31. Before compression, the flash vapor stream in the flash overhead line 66 may be scrubbed of impurities such as hydrogen sulfide, but this is not shown in FIG. 1.

A second hydrocarbon stream enters the hydrotreating unit in line 91. The second hydrogen stream in line 92 may join the second hydrocarbon feed stream in line 91 to provide a hydrotreating feed stream 94. The second hydrocarbon feed stream in line 91 may also be mixed with a co-feed that is not shown. The hydrotreating feed stream 94 may be heat exchanged with the hydrotreating effluent in line 98, further heated in a fired heater and directed to a hydrotreating reactor 96. Consequently, the hydrotreating reactor may be in downstream communication with the flash overhead line 66 of the cold flash drum. As such, the hydrotreating reactor may be in downstream communication with the second split line, the second hydrogen line 92 and the second hydrocarbon feed line 91. In the hydrotreating reactor 96, the second hydrocarbon stream which may be a diesel stream is hydrotreated in the presence of a hydrotreating hydrogen stream and hydrotreating catalyst to provide a hydrotreating effluent stream 98.

The hydrotreating reactor 96 may comprise more than one vessel and multiple beds of catalyst. The hydrotreating reactor 96 in FIG. 1 has two beds in one reactor vessel. In the hydrotreating reactor 96, hydrocarbons with heteroatoms are further demetallized, desulfurized and denitrogenated. The hydrotreating reactor may also contain hydrotreating catalyst that is suited for saturating aromatics, hydrodewaxing and hydroisomerization.

If the hydrocracking reactor 46 is operated as a mild hydrocracking reactor, the hydrocracking reactor may operate to convert up to about 20-60 vol-% of feed boiling above diesel boiling range to product boiling in the diesel boiling range. Consequently, the hydrotreating reactor 96 should have very low conversion and is primarily for desulfurization if integrated with a mild hydrocracking reactor 46 to meet fuel specifications such as qualifying for ULSD.

Hydrotreating is a process wherein hydrogen is contacted with hydrocarbon in the presence of suitable catalysts which are primarily active for the removal of heteroatoms, such as sulfur, nitrogen and metals from the hydrocarbon feedstock. In hydrotreating, hydrocarbons with double and triple bonds may be saturated. Aromatics may also be saturated. Some hydrotreating processes are specifically designed to saturate aromatics. The cloud point of the hydrotreated product may also be reduced. Suitable hydrotreating catalysts for use in the present invention are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal is selected from palladium and platinum. It is within the scope of the present invention that more than one type of hydrotreating catalyst be used in the same hydrotreating reactor 96. The Group VIII metal is typically present in an amount ranging from about 2 to about 20 wt-%, preferably from about 4 to about 12 wt-%. The Group VI metal will typically be present in an amount ranging from about 1 to about 25 wt-%, preferably from about 2 to about 25 wt-%.

Preferred hydrotreating reaction conditions include a temperature from about 290° C. (550° F.) to about 455° C. (850° F.), suitably 316° C. (600° F.) to about 427° C. (800° F.) and preferably 343° C. (650° F.) to about 399° C. (750° F.), a pressure from about 2.1 MPa (300 psig), preferably 4.1 MPa (600 psig) to about 6.9 MPa (1000 psig), a liquid hourly space velocity of the fresh hydrocarbonaceous feedstock from about 0.5 $hr^{-1}$ to about 4 $hr^{-1}$, preferably from about 1.5 to about 3.5 $hr^{-1}$, and a hydrogen rate of about 168 to about 1,011 $Nm^3/m^3$ oil (1,000-6,000 scf/bbl), preferably about 168 to about 674 $Nm^3/m^3$ oil (1,000-4,000 scf/bbl) for diesel feed, with a hydrotreating catalyst or a combination of hydrotreating catalysts.

The hydrotreating effluent stream in line 98 may be heat exchanged with the hydrotreating feed stream in line 94. At least a portion of the hydrotreating effluent stream in line 98 which may comprise hydrogen and diesel may be mixed with at least a portion of the hydrocracking effluent stream transported in line 48.

The mixing may be performed downstream of the cold separator 50 and preferably with the liquid hydrocracking effluent in the cold separator bottoms line 54. In this aspect, the bottoms line 54 of the cold separator 50 is joined by and in downstream communication with the hydrotreating effluent line 98. The combine line 58 carries the liquid hydrocracking effluent and the hydrotreating effluent into the cold flash drum 64. It is also contemplated that the mixing may be performed in the cold flash drum 64. The cold flash drum 64 is in downstream communication with the hydrotreating reactor 96 and the cold separator 50 via the bottoms line 54. Consequently, the hydrotreating effluent stream in line 98 is mixed with at least a portion of the hydroprocessing effluent stream which may be the hydrocracking effluent stream in line 48.

The hydrotreated effluent may enter the bottoms line 54 or the cold flash drum 64 because the cold flash drum pressure is reduced from operating hydroprocessing pressure and from the cold separator pressure to be equivalent to the hydrotreating pressure. In an aspect, portions of the hydrotreating effluent stream may be taken for alternative processing. In an aspect, however, the entire hydrocarbons and gases in the hydrotreating effluent stream in line 98 which join the liquid hydrocracking effluent in the bottoms line 54 and may be processed after heating therewith first by entering the cold flash drum 64. Consequently, the cold flash drum 64 and, thereby, the second recycle compressor 90 are in downstream communication with the hydrotreating reactor 96.

The cold separator liquid and the hydrotreating effluent enter the cold flash drum 64 perhaps via bottoms line 58 and are flashed into the cold flash vapor stream in the flash overhead line 66 which can be recycled back as at least a portion of the second hydrogen line 92 and fed to the hydrotreating reactor 96. Hence, the second hydrogen line 92 is in downstream communication with the cold flash overhead line 66.

The cold flash drum 64 serves to separate hydrogen from hydrotreating effluent and hydroprocessing effluent for recycle to the hydrotreating reactor 96. The cold flash vapor stream in flash overhead line 66 may be scrubbed of impurities such as hydrogen sulfide before undergoing compression in second recycle compressor 90, but this may not be necessary. The recycle compressor 90 is in downstream communication with said cold flash overhead line 66. Accordingly, recycle gas loops from both the hydrocracking section 12 and the hydrotreating section 14 utilize separate recycle gas compressors 60 and 90, respectively.

The liquid hydrotreating effluent and liquid hydroprocessed effluent in the cold flash bottoms line 68 may be fractionated in the fractionation section 16. The fractionation section 16 may be in downstream communication with the hydrotreating reactor 96 through hydrotreating effluent line 98.

Figure 2:
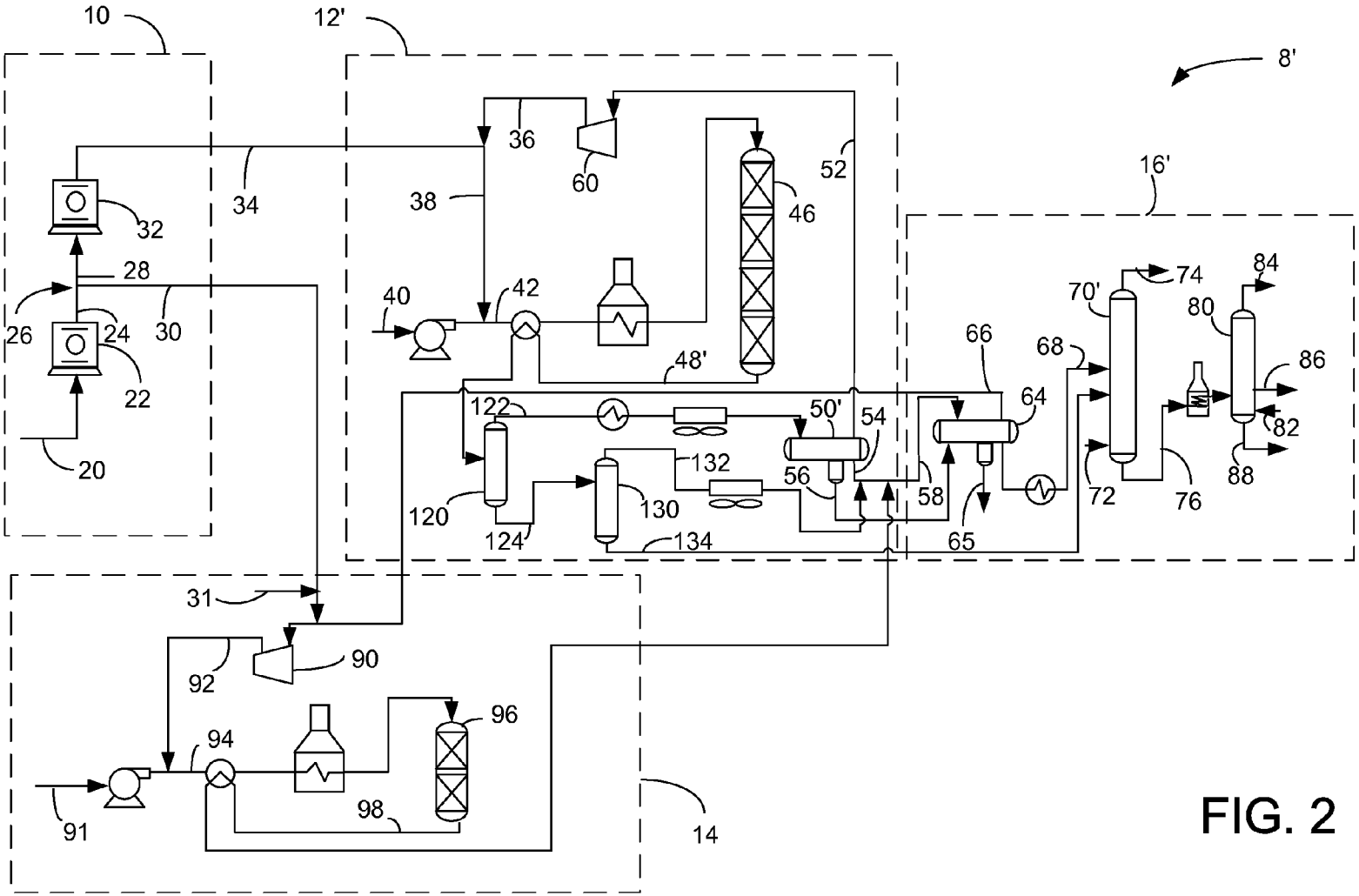
FIG. 2 is a simplified process flow diagram of an alternative embodiment of the present invention.

FIG. 2 illustrates an embodiment of a process and apparatus 8' that utilizes a hot separator 120 to initially separate the hydrocracking effluent in line 48'. Many of the elements in FIG. 2 have the same configuration as in FIG. 1 and bear the same reference number. Elements in FIG. 2 that correspond to elements in FIG. 1 but have a different configuration bear the same reference numeral as in FIG. 1 but are marked with a prime symbol (').

The hot separator 120 in the hydroprocessing section 12' is in downstream communication with the hydroprocessing reactor 46 and provides a vaporous hydrocarbonaceous stream in an overhead line 122 and a liquid hydrocarbonaceous stream in a bottoms line 124. The hot separator 120 operates at about 177° C. (350° F.) to about 343° C. (650° F.) and preferably operates at about 232° C. (450° F.) to about 288° C. (550° F.). The hot separator may be operated at a slightly lower pressure than the hydroprocessing reactor 46 accounting for pressure drop. The vaporous hydrocarbonaceous stream in the overhead line 122 may be joined by the hydrotreating effluent stream in line 98 from the hydrotreating section 14 and be mixed and transported together in the overhead line 122 which arrangement is not shown. Preferably, the vaporous hydrocarbonaceous stream in the overhead line 122 may be cooled before entering the cold separator 50'. Consequently, the vaporous hydrocarbonaceous stream may be separated in the cold separator 50' to provide the vaporous hydroprocessing effluent comprising hydrogen in overhead line 52 and the liquid hydroprocessing effluent in the bottoms line 54 and which are processed as previously described with respect to FIG. 1. The cold separator 50', therefore, is in downstream communication with the overhead line 122 of the hot separator 120.

The liquid hydrocarbonaceous stream in the bottoms line 124 may be fractionated in the fractionation section 16'. In an aspect, the liquid hydrocarbonaceous stream in the bottoms line 124 may be flashed in a hot flash drum 130 to provide a light ends stream in an overhead line 132 and a heavy liquid stream in a bottoms line 134. The hot flash drum 130 may be operated at the same temperature as the hot separator 120 but at a lower pressure of between about 2.1 MPa (gauge) (300 psig) and about 6.9 MPa (gauge) (1000 psig). The heavy liquid stream in bottoms line 134 may be further fractionated in the fractionation section 16'. In an aspect, the heavy liquid stream in line 134 may be introduced into the stripping column 70' at a lower elevation than the feed point of the cold flash liquid stream in line the flash bottoms line 68.

The rest of the embodiment in FIG. 2 may be the same as described for FIG. 1 with the previous noted exceptions.

Figure 3:
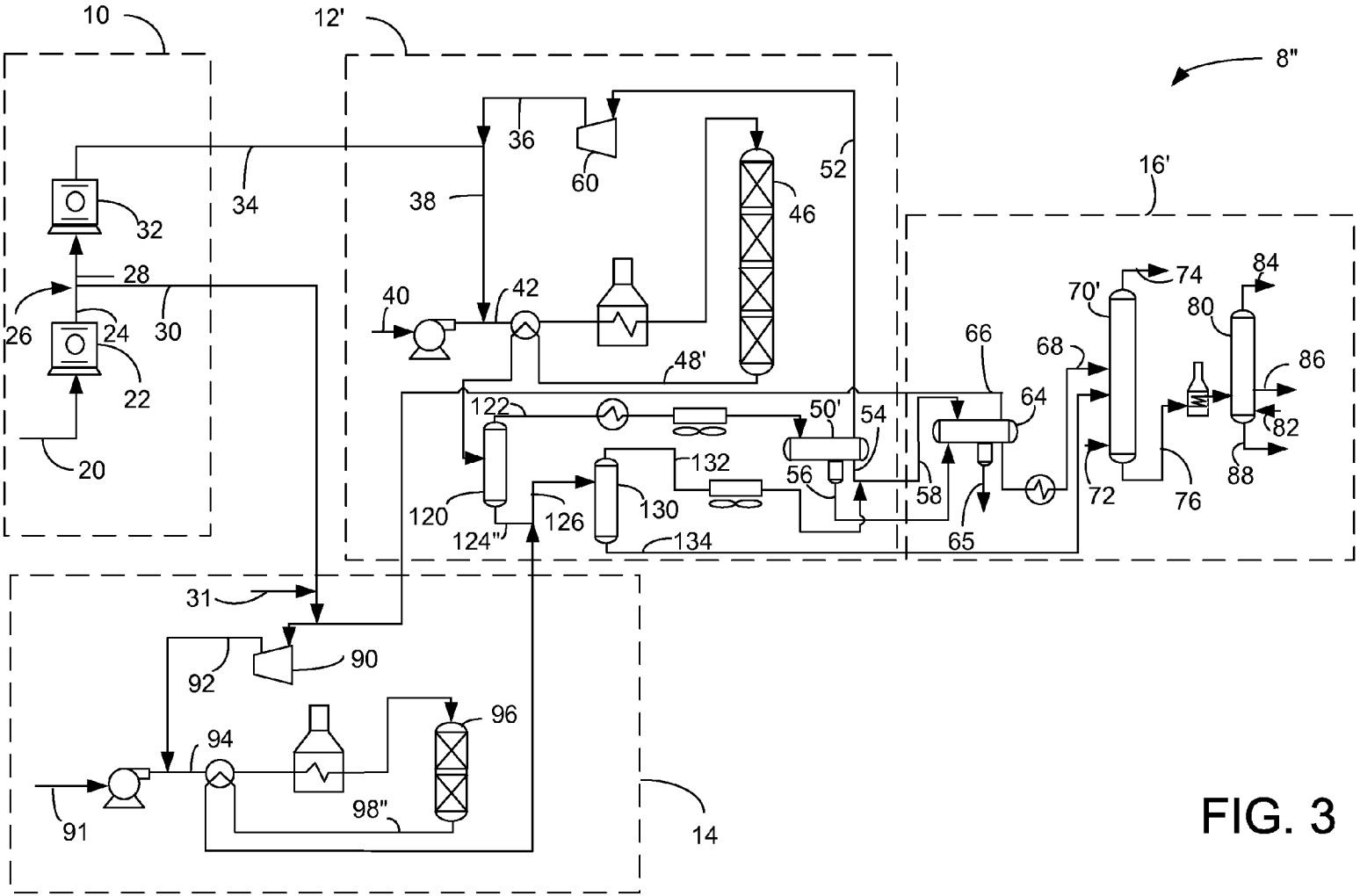
FIG. 3 is a simplified process flow diagram of an additional alternative embodiment of the present invention.

FIG. 3 illustrates an embodiment of a process and apparatus 8" that utilizes a hot separator 120 to initially separate the hydrocracking effluent in hydroprocessing effluent line 48'. Many of the elements in FIG. 3 have the same configuration as in FIGS. 1 and 2 and bear the same respective reference number. Elements in FIG. 3 that correspond to elements in FIGS. 1 and 2 but have a different configuration bear the same reference numeral as in FIG. 2 but are marked with a double prime symbol (").

In FIG. 3, hydrotreating effluent in hydrotreating effluent line 98" is directed to the hot bottoms line 124" to be mixed with the liquid hydrocarbonaceous stream instead of to the liquid hydroprocessing effluent stream in cold bottoms line 54 as in FIG. 2. The hydrotreating effluent is then directed in combine line 126 along with the liquid hydrocarbonaceous stream to the hot flash drum 130 and is processed thereafter as described in FIG. 2. Accordingly, the hot bottoms line 124" and the hot flash drum 130 are in downstream communication with the hydrotreating reactor 96 and the hydrotreating effluent line 98" due to the joint between the hydrotreating effluent line 98" and the hot bottoms line 124". It is also contemplated that hydrotreating effluent in hydrotreating effluent line 98" enter the hot flash drum 130 separately from the liquid hydrocarbonaceous stream in hot bottoms line 124".

The rest of the embodiment in FIG. 3 may be the same as described for FIGS. 1 and 2 with the previous noted exceptions.

Preferred embodiments of this invention are described herein, including the best mode known to the inventors for carrying out the invention. It should be understood that the illustrated embodiments are exemplary only, and should not be taken as limiting the scope of the invention.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated. Pressures are given at the vessel outlet and particularly at the vapor outlet in vessels with multiple outlets.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A hydrocracking and hydrotreating apparatus comprising:

a first compressor on a make-up hydrogen line to provide a first compressed make-up hydrogen stream in a first compressed make-up hydrogen line;

a split in communication with first compressor for splitting said first compressed make-up hydrogen stream between a first split line and a second split line;

a second compressor on said first split line to provide a second compressed make-up hydrogen stream;

a hydrocracking reactor in communication with a first hydrogen line and a first hydrocarbon feed line for hydrocracking a hydrocarbon stream to lower boiling hydrocarbons transported in a hydrocracking effluent line, said hydrocracking reactor being in communication with said first split line;

a hydrotreating reactor in communication with a second hydrogen line and a second hydrocarbon feed line for hydrotreating a diesel stream to produce a hydrotreating effluent in a hydrotreating effluent line, said hydrotreating reactor being in communication with said second split line;

said hydrotreating effluent line in communication with said hydrocracking effluent line; and a fractionation section in communication with said hydrotreating effluent line and said hydrocracking effluent line.

2. The apparatus of claim 1 further comprising a cold separator for separating said hydrocracking effluent to provide a vaporous hydrocracking effluent stream comprising hydrogen in an overhead line and a liquid hydrocracking effluent stream in a bottoms line.

3. The apparatus of claim 2 further comprising a hot separator for separating said hydrocracked effluent into a vaporous hydrocarbonaceous stream in an overhead line and a liquid hydrocarbonaceous stream in a bottoms line and said cold separator in communication with said vaporous hydrocarbonaceous stream in said overhead line.

4. The apparatus of claim 2 wherein said first hydrogen line is in communication with said vaporous hydrocracking effluent overhead line.

5. The apparatus of claim 2 wherein said hydrotreating effluent line is in communication with said liquid hydrocracking effluent line.

6. The apparatus of claim 5 further comprising a flash drum in communication with said hydrotreating effluent line and said liquid hydrocracking effluent line for providing a cold flash vapor stream in a flash overhead line and a cold flash liquid stream in a flash bottoms line.

7. The apparatus of claim 6 further comprising a fractionation column in communication with said flash bottoms line for fractionating the cold flash liquid stream in a fractionation section.

8. The apparatus of claim 6 wherein said second hydrogen line is in communication with said flash overhead line.

9. The apparatus of claim 8 further comprising a recycle compressor in communication with said flash overhead line.

10. A hydrocracking and hydrotreating apparatus comprising:

a first compressor on a make-up hydrogen line to provide a first compressed make-up hydrogen stream in a first compressed make-up hydrogen line;

a split in communication with first compressor for splitting said first compressed make-up hydrogen stream between a first split line and a second split line;

a second compressor on said first split line to provide a second compressed make-up hydrogen stream;

a hydrocracking reactor in communication with a first hydrogen line and a first hydrocarbon feed line for hydrocracking a first hydrocarbon feed stream to lower boiling hydrocarbons transported in a hydrocracking effluent line, said hydrocracking reactor being in communication with said first split line;

a cold separator in communication with said hydrocracking effluent line for separating said hydrocracking effluent into a vaporous hydrocracking effluent stream comprising hydrogen in an overhead line and a liquid hydrocracking effluent stream in a bottoms line;

a hydrotreating reactor in communication with a second hydrogen line and a second hydrocarbon feed line for hydrotreating a second hydrocarbon feed stream to produce hydrotreating effluent in a hydrotreating effluent line, said hydrotreating reactor being in communication with said second split line;

said hydrotreating effluent line in communication with said bottoms line; and a fractionation section in communication with said hydrotreating effluent line and said cold separator.

11. The apparatus of claim 10 further comprising a hot separator for separating said hydrocracked effluent into a vaporous hydrocarbonaceous stream in an overhead line and a liquid hydrocarbonaceous stream in a bottoms line and said cold separator in communication with said overhead line.

12. The apparatus of claim 10 wherein said first hydrogen line is in communication with said overhead line.

13. The apparatus of claim 10 further comprising a flash drum in communication with said hydrotreating effluent line and said bottoms line for providing a cold flash vapor stream in a flash overhead line and a cold flash liquid stream in a flash bottoms line.

14. The apparatus of claim 13 further comprising a fractionation column in communication with said flash bottoms line for fractionating the cold flash liquid stream in a fractionation section.

15. The apparatus of claim 13 wherein said second hydrogen line is in communication with said flash overhead line.

16. The apparatus of claim 15 further comprising a recycle compressor in communication with said flash overhead line.

17. A hydrocracking and hydrotreating apparatus comprising:

a first compressor on a make-up hydrogen line to provide a first compressed make-up hydrogen stream in a first compressed make-up hydrogen line;

a split in communication with first compressor for splitting said first compressed make-up hydrogen stream between a first split line and a second split line;

a second compressor on said first split line to provide a second compressed make-up hydrogen stream;

a hydrocracking reactor in communication with a first hydrogen line and a first hydrocarbon feed line for hydrocracking a first hydrocarbon feed stream to lower boiling hydrocarbons transported in a hydrocracking effluent line, said hydrocracking reactor being in communication with said first split line;

a cold separator in communication with said hydrocracking effluent line for separating said hydrocracking effluent into a vaporous hydrocracking effluent stream comprising hydrogen in an overhead line and a liquid hydrocracking effluent stream in a bottoms line;

said first hydrogen line being in communication with said overhead line;

a hydrotreating reactor in communication with a second hydrogen line and a second hydrocarbon feed line for hydrotreating a second hydrocarbon feed stream to produce hydrotreating effluent in a hydrotreating effluent line, said hydrotreating reactor being in communication with said second split line;

a flash drum in communication with said hydrotreating effluent line and said liquid hydrocracking effluent line for providing a cold flash vapor stream in a flash overhead line and a cold flash liquid stream in a flash bottoms line; and said second hydrogen line being in communication with said flash overhead line.

18. The apparatus of claim 17 further comprising a fractionation section in communication with said flash bottoms line.

* * * * *